United States Patent [19]

Deubel

[11] 4,001,751

[45] Jan. 4, 1977

[54] NON-RESETTABLE THERMOSTAT

[75] Inventor: Bernard S. Deubel, Mansfield, Ohio

[73] Assignee: Therm-O-Disc, Incorporated, Mansfield, Ohio

[22] Filed: Oct. 22, 1975

[21] Appl. No.: 624,968

[52] U.S. Cl. ..... 337/343; 337/365

[51] Int. Cl.[2] ..... H01H 37/74

[58] Field of Search ..... 337/333, 89, 343, 348, 337/365, 367, 379

[56] References Cited

UNITED STATES PATENTS

| | | | |
|---|---|---|---|
| 3,470,517 | 9/1969 | Ohlemacher et al. | 337/343 X |
| 3,715,697 | 2/1973 | Them | 337/333 X |
| 3,852,697 | 12/1974 | Snider | 337/348 |

*Primary Examiner*—George Harris
*Attorney, Agent, or Firm*—McNenny, Pearne, Gordon, Gail, Dickinson & Schiller

[57] ABSTRACT

A thermal fuse is disclosed in which a non-resettable bimetal snap disc operates with snap action to open the switch. The body assembly is provided by a unitary cup shaped molded body and a metallic disc cup which cooperate to enclose the switch cavity. The terminal and switch contact means are mounted on lateral projections and extend through adjacent openings into the switch cavity. A bumper extends between the disc and the movable contact to operate the switch in response to snap movement of the disc. The bumper is guided in opposed channels formed in the side of the body so that it is not necessary to provide an apertured wall or shield between the disc and the switch. Means are provided to allow resetting of the device after test operation during manufacture, but such mans are not available for user resetting of the device.

9 Claims, 5 Drawing Figures

Fig. 1
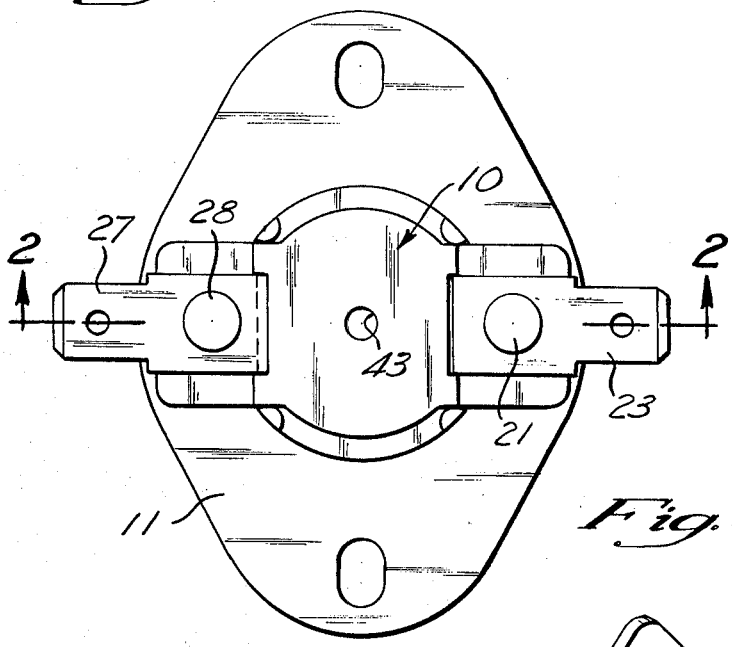
Fig. 3
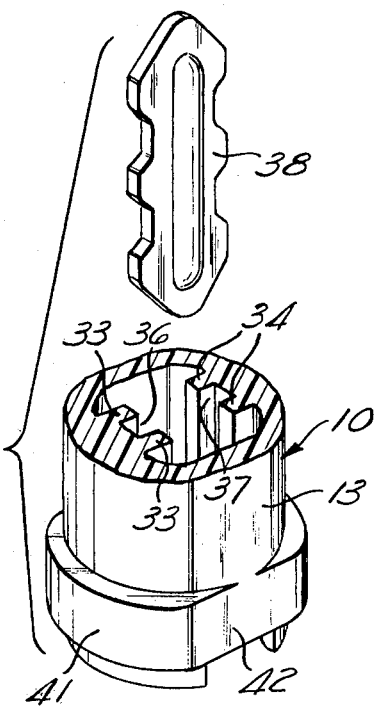
Fig. 5
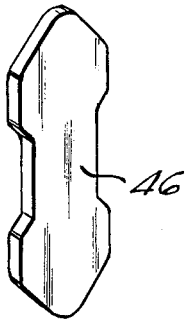
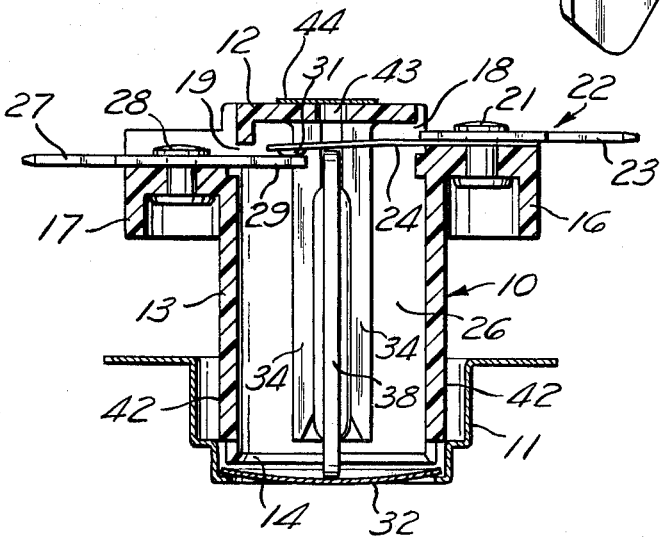
Fig. 2
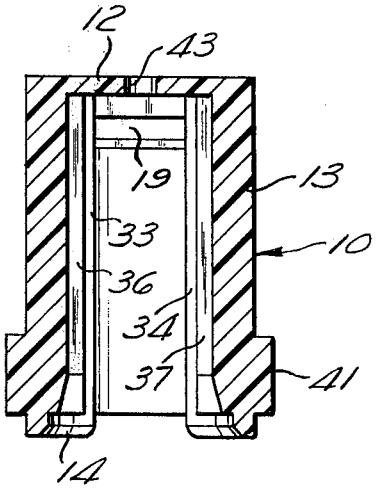
Fig. 4

NON-RESETTABLE THERMOSTAT

BACKGROUND OF THE INVENTION

This invention relates generally to bimetal snap disc temperature responsive devices, and more particularly to a novel and improved low cost device of such type suitable for use as a thermal fuse wherein the device is intended to operate only once and then be discarded and replaced.

PRIOR ART

Generally, snap disc temperature responsive devices including limit controls are intended for repeated operation, and are either automatically resetting or manual resetting types. Such devices must be capable of repeated operation and can, therefore, be relatively expensive and still be commercially satisfactory. However, in some installations, safety and other such considerations require that a limit device, once it operates, be incapable of being reset to insure that the protected system will not be reactivated without repair. Such limit devices are sometimes referred to as thermal fuses, since they operate only once and then have to be replaced. Because thermal fuses must be replaced rather than be reset, it is important to minimize to the greatest possible extent the manufacturing costs of the device.

The U.S. Pat. to Them, No. 3,715,697 issued Feb. 6, 1973, discloses a bimetal snap disc thermal fuse and the U.S. Pat. to Schmitt No. 3,861,032 issued Jan. 21, 1975, discloses a method of manufacturing and testing such devices. Both of these patents are assigned to the assignee of the present invention.

SUMMARY OF THE INVENTION

The present invention provides a structure which can be manufactured with sufficiently low cost to permit it to be economically used as a thermal fuse, which is discarded and replaced after a single operation. The illustrated embodiment is provided with a one-piece body which cooperates with a disc cap to provide a complete body assembly. A simple but reliable switch is assembled through lateral openings in the body and is enclosed without requiring a separate cover member or the like. A structurally simple bumper is guided in opposed channels formed in the body and it is not necessary to provide an apertured wall or shield between the disc and the switch to position and guide the bumper.

The various structural elements are arranged to minimize the manufacturing costs with respect to the amount of material required for manufacture, the cost of producing parts, and the cost of assembly.

The illustrated embodiment includes a molded one-piece, cup-shaped body, provided with an end wall and a generally uniform cross section side wall which defines a relatively long switch cavity and extends to an open end. A pair of opposed and axially offset mounting projections are provided on said body, each of which is adjacent to a lateral opening through the side wall. A unitary terminal and fixed contact member is riveted to one mounting projection and extends through the associated opening into the switch cavity of the body. A movable contact assembly including a terminal member and a cantilever spring arm is riveted to the other mounting projection with the spring arm projecting through the associated opening into the switch cavity. The offset between the two projections properly positions the spring arm and the fixed contact for engagement with the switch is closed by the spring bias of the spring arm. The contact surface is not provided with separate contacts, but is preferably silver plated to provide good current capacity at low cost.

The bumper is generally rectangular in shape and is guided along opposite sides by channels formed in the side walls of the body. The width of the bumper approaches the maximum lateral dimension of the cavity so it is not necessary to project the guide channels inwardly a substantial amount in a manner which would require greater volume of materials to form the body. The length of the switch cavity is sufficiently great so that shorting between the switch and the disc does not occur and so that sufficient length is provided in the guide channels to properly guide the relatively wide bumper. The bumper may be molded or manufactured as a low cost stamping.

BRIEF DESCRIPTION OF THE DRAWINGS

FIG. 1 is a plan view of a preferred thermal fuse incorporating the present invention;

FIG. 2 is a side elevation in longitudinal section taken generally along 2—2 of FIG. 1;

FIG. 3 is an exploded cutaway perspective view illustrating the structure of the molded body and bumper;

FIG. 4 is a longitudinal section of the unitary body taken at right angles to the section of FIG. 2; and, FIG. 5 is a perspective view of a modified form of bumper which is formed by stamping.

DETAILED DESCRIPTION OF THE DRAWINGS

The illustrated embodiment of this invention includes a unitary body 10 preferably molded from a phenolic resin or the like and a metallic disc cup 11, which cooperates with the body to form the body assembly of the device.

The body 10 is generally cup shaped and provides an end wall 12 and side walls 13, which extend from the end wall 12 to an open end 14. Projecting from opposite sides of the body side wall 13 are first and second outwardly extending mounting projections 16 and 17. Adjacent to each of the projections 16 and 17 is an opening 18 and 19, respectively, through the side wall 13. Mounted on the upper surface of the projection 14 by a rivet 21 is a first terminal and contact assembly 22, which includes a terminal member 23 and a cantilever spring arm 24, which extends through the opening 18 into the switch cavity 26, defined by the body 10 and the disc cup 11. A second contact and terminal is provided by a unitary element 27 which is secured to the projection 17 by a rivet 28 and extends inwardly through the opening 19 into the switch cavity 26. The inner end of the unitary element 27 constitutes the fixed contact 29 of the switch and is engaged by a dimple 31 formed in the free end of the spring arm 24. The outer end of the unitary element 27 and the outer end of the terminal 23 are formed to be connected to typical terminal connectors so that the switch can be connected in any desired circuit.

The disc cup 11 supports a bimetal snap disc 32, which is formed with a shallow dished shape so that it moves with snap action between the illustrated, unoperated position and an upwardly curved operated position upon reaching a predetermined temperature. When the device incorporating the present invention is intended for use as a thermal fuse, the bimetal snap disc 32 is formed so that it snaps from its unoperated position to its operated position, upon reaching the required operating temperature of the device, but is incapable of returning to its unoperated position under the influence of thermally induced forces within the environmental temperature range expected to be encountered by the device. Such disc is non-automatic in that it does not return to its initial position after operation to its operated position. Such non-automatic discs are well known to persons skilled in the art and are often used in manual reset limit devices. Reference may be made to the U.S. Pat. to Snider, No. 3,852,697, issued Dec. 3, 1974 (assigned to the assignee of the present invention) for a more detailed description of non-automatic discs and more particularly, to a particular type of non-automatic disc.

The inner surface of the side wall 13 is substantially uniform in cross section and is provided with opposed pairs of inwardly extending projections 33 and 34, which cooperate to define opposed longitudinally extending channels 36 and 37, for guiding a bumper 38. The bumper 38, which is best illustrated in FIG. 3, is an elongated member molded from plastic material such as a phenolic resin, which is proportioned to be positioned along opposite edges in the channels 36 and 37 for axial movement. The length of the bumper 38 is selected so that the switch remains closed when the disc 32 is in the unoperated position. Movement of the disc to the operated position causes the bumper to be moved in the direction of the switch and causes the contact portion 31 of the spring arm 24 to be moved out of contact with the fixed contact 29 to open the switch. As long as the disc remains in the operated position, the switch remains open to break the circuit between the two terminals 23 and 27.

The lateral spacing between the channels 36 and 37 is not substantially less than the maximum lateral dimension of the switch cavity 26 so that excessive material is not required to form the body 10. Further, the length of the channels 36 and 37 and of the bumper 38 is selected so that the guided length of the bumper is at least as great as the width of the bumper so that smooth guiding is obtained. Further, the length of the body is selected so that a substantial spacing is provided between the disc and the switch to insure complete electrical isolation.

In the illustrated embodiment, the side wall 13 of the body 10 is formed with flats aligned with each of the projections 16 and 17 to insure adequate clearance to install the two rivets 21 and 28 while maintaining a relatively close spacing between the rivets.

An annular rib 41 is molded on the exterior of the body 10, adjacent to the open end and is proportioned to fit into the disc retaining cup. The rib 41, however, is flatted on opposite sides at 42 so as to prevent interference with the riveting operation. The disc cup is normally secured to the body by dimpling in the wall over the upper surface of the rib 41.

The upper surface of the projection 16 is spaced from the disc 32 by a distance slightly greater than the spacing between the disc 32 and the upper surface of the projection 17, so that such upper surfaces are offset, as best illustrated in FIG. 2. With this arrangement, the spring arm 24 projects into the switch cavity and engages the side of the fixed contact 29 on the side thereof remote from the disc 32, without requiring offset bends or the like in the spring arm 24.

When the device is intended to operate as a thermal fuse, it is not necessary to provide contacts which are capable of many cycles of operation. In such instances, one or more of the contact surfaces is plated with silver or other good electrical conducting material when the current carrying capacities require such surface.

The upper wall 12 is provided with an opening 43 aligned with the center of the bumper 38 to permit test operation of the device and subsequent resetting during the manufacture of the device. In such testing, the device is assembled and subjected to the temperature at which operation of the device is required. After the disc operates, it will not thermally reset so a tool is inserted through the opening 43 to press against the spring arm 24, and in turn, the bumper 38 to reset the disc. After the disc is reset and the testing is completed, the opening 43 is preferably closed so that the user cannot reset the disc.

In the illustrated embodiment, a name plate or the like 44 is secured by adhesive over the opening 43. Alternatively, the opening can be filled with plastic or the like to prevent user resetting of the device.

FIG. 5 illustrates a modified form of bumper which is stamped from sheet material such as a glass-epoxy resin material to minimize manufacturing cost. Such bumper 46 has the same general shape as the bumper 38, but is formed by stamping it out of sheet material, rather than by molding to reduce costs.

Although preferred embodiments of this invention are illustrated, it should be understood that various modifications and rearrangements of parts may be resorted to without departing from the scope of the invention disclosed and claimed herein.

What is claimed is:

1. A bimetal snap disc thermal device comprising a one-piece molded cup shaped body providing an elongated switch cavity of substantially uniform cross section defined by an end wall and a side wall which extends to an open end, a pair of support projections extending outwardly in opposite directions from said side wall for supporting a switch, an opening in said side wall adjacent to each projection, a switch including contact and terminal means riveted to each projection and extending laterally through the associated opening into said cavity, a disc cup mounted on said body at said open end, a bimetal snap disc positioned by said disc cup at said open end, and a bumper in said body operating said switch in response to snap movement of said disc, said body providing opposed and laterally spaced guide channels in said side wall having a length at least substantially equal to the spacing therebetween, said bumper being generally rectangular and providing opposed sides positioned in said guide channels to guide and position said bumper.

2. A thermal device as set forth in claim 1 wherein said disc snaps to an operative position and operates said switch upon reaching a predetermined temperature and thereafter remains in said operative position at all temperature normally encountered by said thermal device.

3. A thermal device as set forth in claim 2 wherein said body and cup enclose said disc to prevent user resetting of said disc, and movement of said disc to said operative position opens said switch.

4. A thermal device as set forth in claim 3 wherein said end wall is provided with an opening therethrough for access to reset said disc after test operation during manufacture, and said opening is closed to prevent resetting after manufacture is completed.

5. A thermal device as set forth in claim 4 wherein one contact and terminal means includes a spring arm riveted on one of said support projections, said spring arm being biased into engagement with the other contact and terminal means.

6. A thermal device as set forth in claim 5 wherein at least one of said terminal and contact means is provided with silver plating or the like to provide improved electrical conductivity.

7. A thermal device as set forth in claim 2 wherein at least one of said terminal and contact means is provided with silver plating or the like to provide improved electrical conductivity.

8. A thermal device as set forth in claim 1 wherein the outer surface of said side wall is provided with opposed flats of reduced diameter aligned with said support projections.

9. A thermal device as set forth in claim 1 wherein said support projections and associated openings are offset with respect to each other in the direction of the length of said switch cavity, and one of said terminal and contact means includes a cantilever mounted spring arm mounted on the support projections spaced furthest from said disc, said spring arm being spring biased in any direction toward said disc into engagement with the other terminal and contact means.

* * * * *